US009999309B2

(12) United States Patent
Tran

(10) Patent No.: US 9,999,309 B2
(45) Date of Patent: Jun. 19, 2018

(54) GRAVITY CHOPSTICKS

(71) Applicant: Dang Minh Tran, San Diego, CA (US)

(72) Inventor: Dang Minh Tran, San Diego, CA (US)

( * ) Notice: Subject to any disclaimer, the term of this patent is extended or adjusted under 35 U.S.C. 154(b) by 15 days.

(21) Appl. No.: 14/991,937

(22) Filed: Jan. 9, 2016

(65) Prior Publication Data

US 2017/0196386 A1 Jul. 13, 2017

(51) Int. Cl.
*A47G 21/10* (2006.01)
*A47G 21/06* (2006.01)

(52) U.S. Cl.
CPC ..... *A47G 21/103* (2013.01); *A47G 2400/025* (2013.01)

(58) Field of Classification Search
CPC ..... A47G 21/103
USPC ..... 294/99.1, 99.2, 218
See application file for complete search history.

(56) References Cited

U.S. PATENT DOCUMENTS 2,789,349 A * 4/1957 Lee ..... B26B 3/02 30/295
D345,486 S * 3/1994 Burdick ..... D7/401.2
D346,722 S * 5/1994 Burdick ..... D7/642
6,328,360 B1 * 12/2001 Freeman ..... A47G 21/103 206/553
D592,019 S * 5/2009 Holcomb ..... D7/643
8,292,343 B2 10/2012 Hsu
8,870,254 B2 10/2014 Marshall, III
9,259,111 B1 * 2/2016 Joyner ..... A47G 21/103
2002/0092181 A1 * 7/2002 Choi ..... A47G 21/103 30/324
2007/0084063 A1 4/2007 Hughes
2007/0220750 A1 * 9/2007 Chen ..... A47G 21/103 30/1
2009/0051179 A1 * 2/2009 Wang ..... A47G 21/103 294/218
2009/0108600 A1 * 4/2009 Ichinose ..... A47G 21/103 294/218
2009/0121501 A1 * 5/2009 Liu ..... A47G 21/10 294/218
2012/0068487 A1 * 3/2012 Wong ..... A47G 21/103 294/218
2013/0133206 A1 5/2013 Donovan

FOREIGN PATENT DOCUMENTS

CN 101099629 11/2010
JP 07194473 * 8/1995 ..... A47G 21/10
JP 2000-201792 * 1/1999 ..... A47G 21/10
JP 2001197994 * 7/2001 ..... A47G 21/10
JP 2012161393 * 8/2012 ..... A47G 21/10

* cited by examiner

*Primary Examiner* — Paul T Chin
(74) *Attorney, Agent, or Firm* — Merle W. Richman, Esq.; CKR Law LLP

(57) ABSTRACT

A chopstick having a handling portion and an eating portion. The handling portion may be made from a first material. The eating portion may be made from a second material that is lighter than the first material. The handling portion may be attached to the eating portion. A pivot point may exist at a connection point between the handling portion and the eating portion. When the chopstick is placed on a horizontal surface, the eating portion may be elevated above a horizontal surface due to the first and second material properties and the pivot point configuration. Thus ensuring that the eating portion of the chopstick remains sanitary and clean, free of germs and dirt.

10 Claims, 4 Drawing Sheets

GRAVITY CHOPSTICKS

FIELD OF THE INVENTION

The present invention relates to a chopstick.

BACKGROUND OF THE INVENTION

A pair of chopsticks are commonly used as an eating utensil. Each chopstick has two ends, one end for picking up food that can be referred to as an eating portion and the other end for holding that can be referred to as a handling portion. Naturally, the end for picking up food, also the eating area of the chopsticks, may be covered with bits of food or sauce when in use. With traditional or conventional chopsticks, a majority of the time the eating area of the chopsticks will touch a surface when placed flat on a horizontal surface, such as a tabletop. To avoid contaminating the eating area of the chopsticks or staining a resting surface area (i.e. table), traditional or conventional chopsticks may require you to rest or lean the chopsticks on a chopstick rest. If there is no chopstick rest then one might rest a section of the chopsticks on another object to prevent the eating area from touching the surface. It may be inconvenient and wasteful to have a separate rest object to rest the chopsticks.

This present invention eliminates the need for a separate rest object with a elevated self-supporting feature. There have been proposals in the prior art for self-supporting chopsticks, however, the prior art proposals have several disadvantages, such as bulky apparatus, inability to separate the chopsticks, limitations on which side the chopstick must rest on, and the inability to instantaneously elevate the eating area of the chopstick above a resting surface to prevent it from touching the surface. For example, in CN 101099629, the chopsticks use a cavity filled with heavy liquid to counterbalance the weight creating the elevated effect. The solution described in said patent has a major disadvantage in that the elevation of the chopsticks is not immediate. A user may have to wait for the liquid substance to flow towards the end of the chopsticks before the eating portion of the chopsticks may gradually rise to elevate it above the desired resting surface area. In U.S. Pat. No. 8,870,254 a pair of tong like chopsticks are disclosed with a weighted self-standing bottom support plane positioned to maintain a distance above a surface without the requirement of a separate chopstick rest. However, in this invention, the chopsticks cannot be separated, it is bulky, and it can only be laid flat on its first and second bottom surfaces or bases. Thus, the eating area is only elevated if the base or holding area of the chopsticks is resting on its first or second bottom base.

This present invention overcomes all of the above shortcomings, because the handling portion of the chopstick is made of a heavier material compared to the eating portion of the chopstick, which counterbalances the chopstick to create an instant elevation of the eating portion when rested. Furthermore, the present invention allows the eating area of the chopsticks to be elevated and self-support above a resting surface regardless of which sides of the holding area the chopstick rest on.

BRIEF SUMMARY OF THE INVENTION

The main objective of the present invention is to provide a chopstick that may instantly elevate the eating portion of the chopstick above a resting surface area, and thus eliminate the need to employ a rest object to rest the chopstick and keep the eating area sanitary when resting the chopstick on a surface.

To accomplish this objective, the chopstick may be made up of two different parts with different weights, the eating portion and the handling portion, whereby the point of pivot is where the two parts connect. The chopstick may be assembled together via a rod connecting the eating portion and the handling portion of the chopstick. The eating portion of the chopstick may be lighter than the handling portion of the chopstick. The eating portion and the handling portion of the chopstick may be tapered towards their respective ends, starting from the point where they are connected by the rod. When laying the chopstick on a horizontal resting surface, the eating portion may be instantly elevated above the horizontal resting surface when the handling portion is heavier than the eating portion, and thus, the chopstick may pivot about where the two portions connect. When the chopstick is assembled, all sides of the handling portion may rest on a horizontal surface while elevating the eating portion. There are no limitations as to which sides of the handling portion the chopstick must rest on to function. The eating portion of the chopstick may instantly elevate and remain elevated above the horizontal surface regardless of which handling portion sides the chopstick rest on.

BRIEF DESCRIPTION OF THE DRAWINGS

These and other features of the invention will become more apparent from the following description in which reference is made to the accompanying drawings illustrating an embodiment thereof, wherein.

DETAILED DESCRIPTION OF THE INVENTION

The chopstick proposed by this present invention eliminates the previously described problems, in that not only can the desired elevation be achieved on all elongated sides of the chopstick, but in addition the elevated self-supporting feature is achieved immediately as opposed to a gradual rise and maintained.

In the description of embodiments of the invention disclosed herein, any reference to direction or orientation is intended for convenience of description and is not intend in any way to limit the scope of the present invention. Terms such as "attached", "connected" refer to a relationship wherein parts are secured or attached to one another either directly or indirectly through intervening parts.

Figure 1:
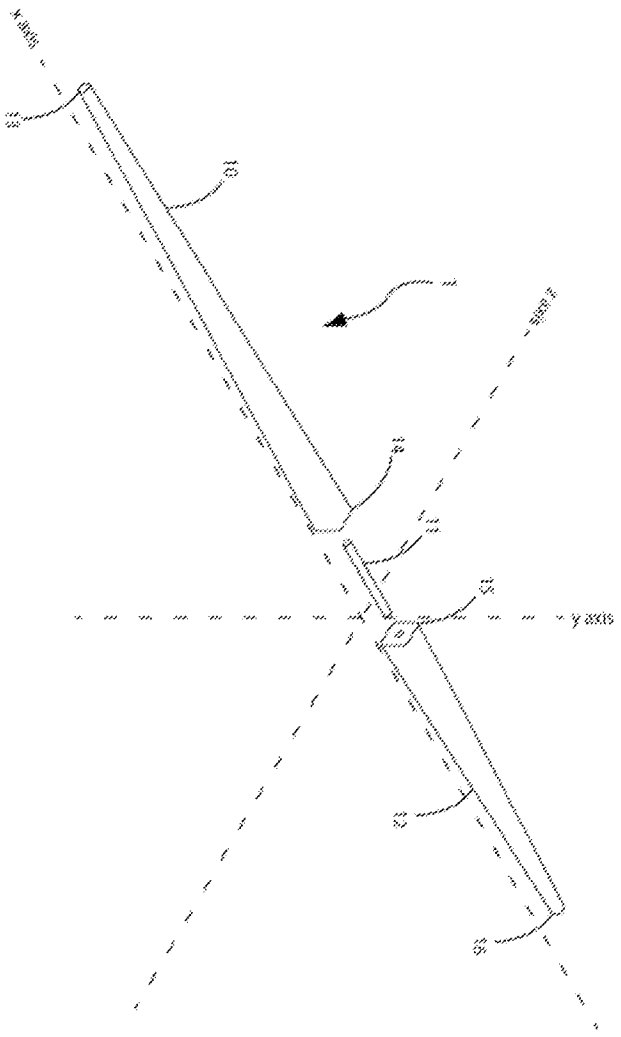
FIG. 1 is a perspective view of a chopstick of the invention, showing the chopstick in an exploded view positioned along the three-dimensional Cartesian coordinate system.
Figure 2:
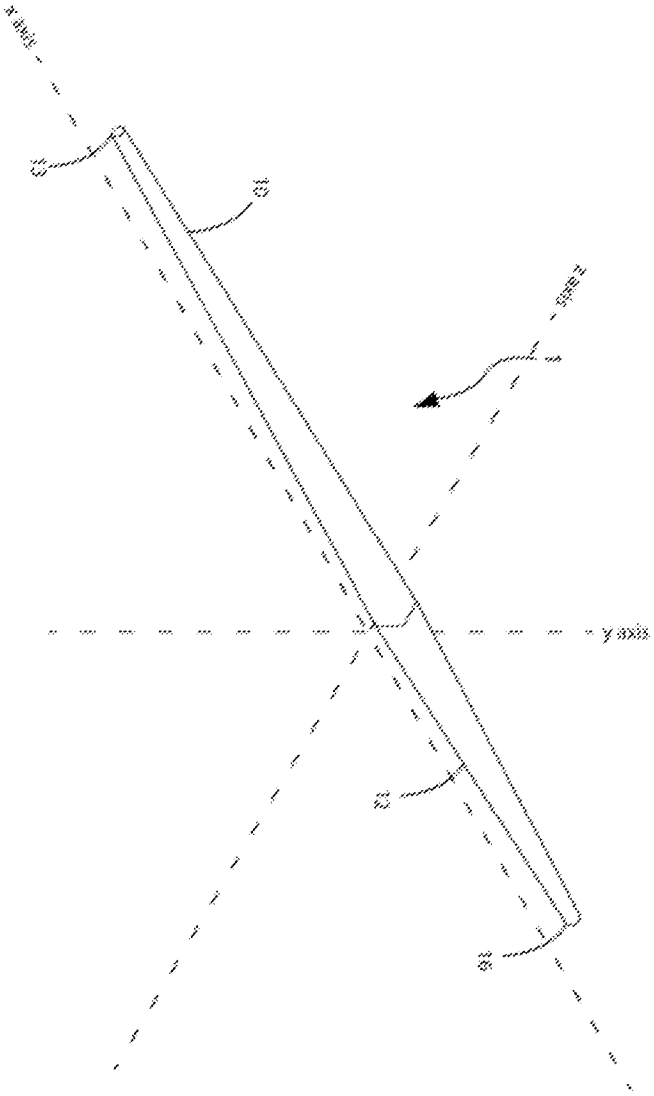
FIG. 2 is a perspective view of the chopstick of the invention, showing the chopstick of FIG. 1 in an assembled view positioned along the three-dimensional Cartesian coordinate system.
Figure 3:
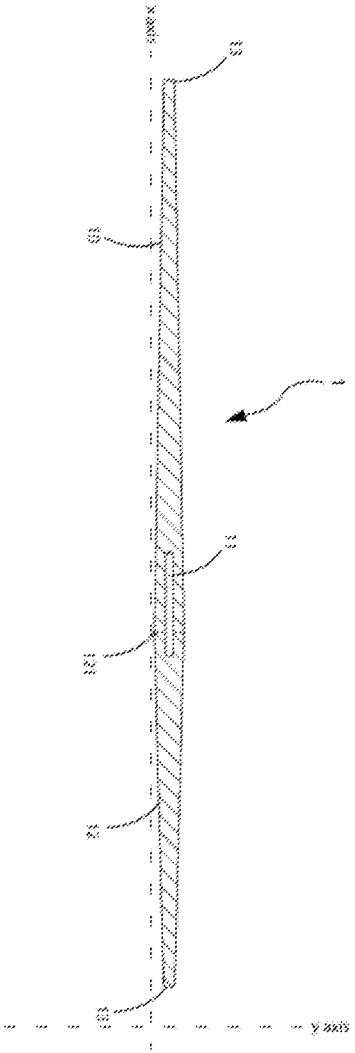
FIG. 3 is a cross-sectional view of FIG. 1 positioned along the X-Y plane of a three-dimensional Cartesian coordinate system.

Features and benefits of the invention should not be limited to the exemplary embodiments nor the scope of the invention being defined by the claims stated herein. Referring to FIGS. 1 and 2, a chopstick 1 in accordance with an embodiment of the present invention is illustrated, in its exploded form as well as assembled form respectively. The chopstick 1 may include an eating portion 10 extending along a section of the longitudinal or x axis, a handling portion 12 extending along a section of the longitudinal or x axis, and a rod 11. The eating portion 10 may be tapered from a first end 14 of the eating portion to a second end 13 of the eating portion, and the handing portion 12 may be tapered from a first end 15 of the handling portion to a second end 16 of the handling portion. In a preferred embodiment, the tapered eating portion 10 and the tapered handling portion 12 may each have four sides forming the portions along a longitudinal direction of the chopstick. The eating portion 10 and the handling portion 12 may each have a hole for the rod 11 to be inserted there into. Further, the holes may be located at a first end 14 of the eating portion and at a first end 15 of the handling portion. The eating portion 10 and the handling portion 12 may be connected by a rod 11 at the first end 14 of the eating portion and the first end 15 of the handling portion. The rod 11 may be inserted further into the hole located at the first end 14 of the eating portion than it is inserted into the hole located at the first end 15 of the handling portion, as referenced in FIG. 3. The eating portion 10 may be made of a lighter material than the handling portion 12. In the exemplified embodiment, the eating portion 10 may be slightly longer than the handling portion 12, however the invention is not so limited in all embodiments and in certain other embodiments the eating portion 10 and the handling portion 12 may vary in length comparative to each other in order to be more ergonomically accommodating to different users.

In the exemplified embodiment, the eating portion 10 may be made of wood, a lighter material than the handling portion 12, which may be made of metal. However, the invention is not limited to the above named materials in all embodiments. In certain embodiments other materials may be used as desired to ensure that the eating portion 10 is lighter than the handling portion 12.

Figure 4:
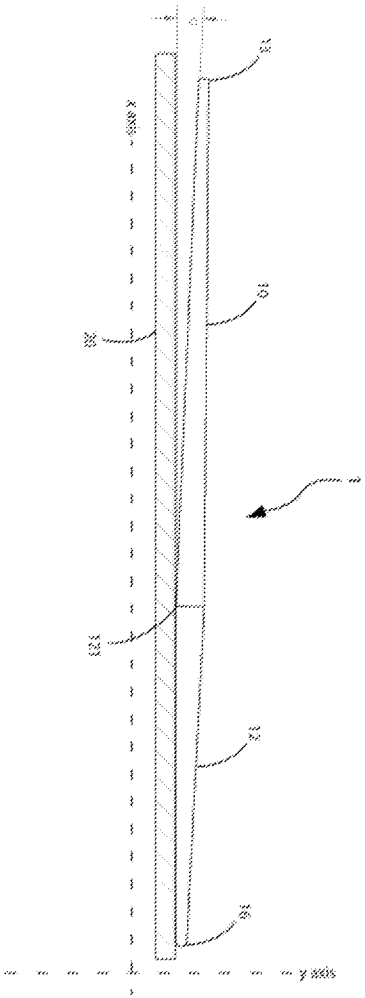
FIG. 4 is a side view of FIG. 1 positioned along the X-Y plane of a three-dimensional Cartesian coordinate system, illustrating the elevated lower end (eating portion) of the chopstick when the chopstick is placed on a horizontal surface to rest.

The handling portion 12 may always be heavier than the eating portion 10 to ensure that the center of mass is on the handling portion. The pivot point may be the connection point 121 between the handling portion and the eating portion, as illustrated in FIG. 4. With the center of mass in the handling portion 12 of the chopstick, and the pivot point at the location where the handling portion 12 and eating portion 10 connects, the lighter eating portion 10 of the chopstick may immediately elevate and remain elevated while not in use to ensure sanitation and cleanliness whenever the chopstick is placed on a horizontal surface, i.e. tabletop. When the chopstick 1 is placed on the horizontal surface, almost no area of the eating portion 10 touches the horizontal surface 20 as illustrated in FIG. 4. This elevated feature reduces the risk of bacteria or dirt from contacting a second end of an eating portion 13 of the chopstick 1, which may come in contact with the user's mouth when in use. In addition, chopstick 1 may eliminate the need for a chopstick rest or the need to rest or lean the chopstick on another object to keep the end of eating portion clean and germ free when resting the chopstick in between uses. The eating portion 10 may instantly elevate above a horizontal surface (i.e. tabletop) regardless of which tapered sides the chopstick 1 is placed on, thus, the chopstick 1 is configured to be self-supporting. All elongated tapered sides of the handling portion 12 may be mirror images of each other, and all elongated tapered sides of the eating portion 10 may be mirror images of each other. However, it should be noted that the invention is not so limited in all embodiments, and in alternative embodiments the eating portion 10 and handling portion 12 may have more than 4 tapered sides and/or may comprise undulations or inward indentations.

The description of the foregoing embodiments is intended to be illustrative, and not to limit the scope of the claims. It will be apparent to one skilled in the art that the present invention, as described above, can be embodied in other specific forms, and that modifications, alternatives and variations may be made to the illustrated embodiment without departing from the spirit and scope of the invention as hereinafter defined in the Claims.

The invention claimed is:

1. A chopstick having a length along a longitudinal axis comprising:

the longitudinal axis including a handling portion adjacent an eating portion between a proximal end and distal end the handling portion extending along a first part of the longitudinal axis for a first length that is ergonomically accommodating to different users and including a proximal end and a distal end, its proximal end at the longitudinal axis proximal end;

the adjacent eating portion extending along a second, different part of the longitudinal axis for a second length including a proximal end and a distal end, its proximal end adjacent the handling section distal end, its distal end at the longitudinal axis distal end, and the second length greater than the first length, and the sum of the first length and the second length equal to the longitudinal axis length;

a pivot point located between the handling portion distal end and the eating portion proximal end;

wherein the handling portion has a heavier fixed mass than the eating section to ensure that the center of mass of the chopstick is on the handling portion so when the chopstick is placed on a horizontal surface, the eating portion is elevated above the horizontal surface about the pivot point, and the handling portion and the eating portion are physically separate elements that are securely coupled together at the handling portion distal end and the eating portion proximal end.

2. The chopstick as claimed in claim 1, wherein the handling portion is tapered from its distal end to its proximal end and the eating portion is tapered from its proximal end to its distal end.

3. The chopstick as claimed in claim 1, wherein the handling portion distal end and the eating portion proximal end are coupled together via a rod.

4. The chopstick as claimed in claim 3, wherein the handling portion distal end and the eating portion proximal end each includes an elongated hole sized for the rod to be securely inserted into to form the chopstick.

5. The chopstick as claimed in claim 4, wherein the eating portion proximal end elongated hole is longer in length than the handling portion distal end elongated hole and the rod is sized so it is inserted further into the eating portion proximal end elongated hole than it is inserted into the handling portion distal end elongated hole when the chopstick is formed.

6. The chopstick as claimed in claim 1, wherein the handling portion is monolithic and made from a first material and the eating portion is monolithic and made from a second material different from the first material.

7. The chopstick as claimed in claim 6, wherein the first material has a higher density than the second material.

8. The chopstick as claimed in claim 6, wherein the first material is a metallic material.

9. The chopstick as claimed in claim 1, wherein the handling portion consists primarily of a first material, the eating portion consists primarily of a second material different from the first material, and the first material has a higher density than the second material.

10. The chopstick as claimed in claim 9, wherein the first material is a metallic material.

* * * * *